US011078676B2

(12) United States Patent
Saygivar et al.

(10) Patent No.: US 11,078,676 B2
(45) Date of Patent: Aug. 3, 2021

(54) ANTI-FALL SAFEGUARD WITH SUPPORTING BASE

(71) Applicants: Fiona Gabriella Saygivar, Rostrevor (GB); Sharon Naomi Saygivar, Rostrevor (GB); Lisa Marie Saygivar, Rostrevor (GB)

(72) Inventors: Fiona Gabriella Saygivar, Rostrevor (GB); Sharon Naomi Saygivar, Rostrevor (GB); Lisa Marie Saygivar, Rostrevor (GB)

( * ) Notice: Subject to any disclaimer, the term of this patent is extended or adjusted under 35 U.S.C. 154(b) by 0 days.

(21) Appl. No.: 16/645,568

(22) PCT Filed: Sep. 7, 2018

(86) PCT No.: PCT/EP2018/000428
§ 371 (c)(1),
(2) Date: Mar. 9, 2020

(87) PCT Pub. No.: WO2019/048078
PCT Pub. Date: Mar. 14, 2019

(65) Prior Publication Data

US 2020/0284054 A1 Sep. 10, 2020

(30) Foreign Application Priority Data

Sep. 8, 2017 (DE) ..... 102017008481

(51) Int. Cl.
*E04G 21/32* (2006.01)
*A62B 35/00* (2006.01)
*E04B 5/38* (2006.01)

(52) U.S. Cl.
CPC ..... *E04G 21/3276* (2013.01); *A62B 35/0068* (2013.01); *E04B 5/38* (2013.01); *E04G 21/3233* (2013.01); *E04B 2103/02* (2013.01)

(58) Field of Classification Search
CPC ..... E04G 21/3276; E04G 21/3233; E04G 21/3252; E04B 5/38; E04B 2103/02; A62B 35/0068
See application file for complete search history.

(56) References Cited

U.S. PATENT DOCUMENTS 6,036,146 A 3/2000 Paterson
6,412,230 B1 7/2002 Zambelli et al.
(Continued)

FOREIGN PATENT DOCUMENTS

DE 60035005 T2 2/2008
DE 102006054408 A1 6/2008
(Continued)

*Primary Examiner* — Patrick J Maestri
(74) *Attorney, Agent, or Firm* — Laurence A. Greenberg; Werner H. Stemer; Ralph E. Locher

(57) ABSTRACT

An anti-fall safeguard for persons includes a supporting base with which the anti-fall safeguard can be set up on an underlying surface formed of individual concrete slabs. The concrete slabs are provided with upwardly projecting iron reinforcing elements and with an anchor mast system which is connected to the supporting base. Personal protective equipment is fastened to the free, upper end of the anchor mast system. In order to securely fasten the anti-fall safeguard on an underlying surface, two or more cable safeguards are provided, which can be brought into connection with the iron reinforcing elements of the concrete slabs. The cable safeguards can be tensioned and the supporting base is immovably secured on the underlying surface by the tensioning of the cable safeguards.

4 Claims, 4 Drawing Sheets

(56) References Cited

U.S. PATENT DOCUMENTS

| | | | | |
|---|---|---|---|---|
| 6,695,095 | B1 | 2/2004 | Franke | |
| 2002/0079164 | A1 | 6/2002 | Choate | |
| 2005/0098381 | A1* | 5/2005 | Flaherty | A62B 35/0056 182/3 |
| 2014/0224579 | A1* | 8/2014 | Balascak | A62B 35/0068 182/3 |
| 2018/0016801 | A1* | 1/2018 | Davis | E01F 13/028 |
| 2019/0234086 | A1* | 8/2019 | Allen | E04G 21/3214 |
| 2019/0240515 | A1 | 8/2019 | Saygivar et al. | |

FOREIGN PATENT DOCUMENTS

| | | | |
|---|---|---|---|
| DE | 102008012232 | A1 | 9/2009 |
| DE | 202016007169 | U1 | 1/2017 |
| GB | 2353818 | A | 3/2001 |
| JP | 2008035953 | A | 2/2008 |

* cited by examiner

ANTI-FALL SAFEGUARD WITH SUPPORTING BASE

BACKGROUND OF THE INVENTION

Field of the Invention

SUMMARY OF THE INVENTION

The invention relates to an anti-fall safeguard for persons with a supporting base, with which the anti-fall safeguard is able to be set up on an underlying surface consisting of individual concrete slabs, wherein the concrete slabs are equipped with reinforcing elements projecting upwards, and an anchoring mast system connected with the supporting base, on the free upper end of which a piece of personal protective equipment (PPE) is attached.

An anti-fall safeguard with supporting base is known, for example, from DE 20 2016 007 169.7 U1. As is perceived from this utility model patent text, such generic anti-fall safeguards are generally utilized where collective safeguards like a lateral safeguard seem inapplicable, or catcher devices such as safety nets appear to be inappropriate. The subject of this utility model is based on safeguards that are crane-like in configuration and equipped with a mast system and an outrigger. In such safeguards, on the outer, upper end of the outrigger, so-called personal safeguards (PPE) are situated.

With a catcher device in the form of a PPE, a cable safeguard is wound up on a kind of drum, which can be made to link with a person with a kind of hook. In the event of a fall or with a jerking load of the cable safeguard, the drum is blocked so that the cable safeguard cannot be further unwound from the drum. If the cable safeguard is again relieved of its load, then the drum is again released so that the person to be safeguarded can again freely move. The main area of application of such systems is principally found in so-called formwork structures for floor formwork. From such floor formworks, "shuttering boards" are laid on support structures, so that altogether these shuttering boards form a kind of "underlying surface," on which a concrete cover can be cast at a later time. Such concrete covers have iron interior reinforcements, so that, depending on the size of the concrete base to be produced, the shuttering boards are braced over a large area, to also be able to apply additional shuttering boards, arranged in distributed fashion over a wide area.

The above-named utility model shows that one of the most frequently used methods is based on attaching the PPE on an outrigger crane with a supporting base and a kind of anchor mast system, to guide the cable safeguard from above to the person to be safeguarded. This method has been shown to be very effective.

What is disadvantageous in this system is that, to ensure stability, core cases or plates need to be included in the planning of the project. Additionally, these components represent a considerable cost component. Since these components can no longer be removed from the supporting structure of the edifice (an already cemented concrete cover), designers specializing in the early phases of structural design regard them with skepticism.

Based on such systems in the form of a "simple crane," according to the above-named utility model patent, an anti-fall safeguard with support base and an anchoring mast system of the particular type was produced.

This special anchor mast system with its two mast elements that "bend" when loaded, has proven to be very advantageous. True, it has been shown that with particular base structures, the support base can "slip" laterally. In this regard, the support base, due to its standing structure directed toward the base, cannot be set up on certain underlying surfaces with any security.

Thus, of late, instead of the above-mentioned shuttering boards, already prefabricated concrete elements with a width of about 6-8 cm are used, which can be placed next to each other over a wide surface. The especial advantage of this is that the underside bracing can have a considerably larger surface, since the number of these concrete slabs to cover the same concrete surface to be cast, is considerably smaller than the individual, substantially smaller shuttering boards.

Such concrete parts and concrete slabs are characterized in that they are equipped at least in part with reinforcing steels. These reinforcing steel parts project out over the upper side of these concrete slabs by a few centimeters, so that the upper side of these concrete slabs does not form a uniform footprint. In addition, the friction coefficient on these iron reinforcement components projecting upwards is very slight, so that the anti-fall safeguard with its support base always tends to shift if there are greater lateral loadings.

Accordingly, the goal of the inventive task is to so configure an anti-fall safeguard at small expense with supporting base in such a way that a lateral shifting or slippage of the entire anchor mast system is prevented.

The goal is achieved, together with the features recited above, in that two or more cable safeguards are provided, which are able to be connected with the reinforcing elements of the concrete slabs, and that the cable safeguards are tensible, and that the support base, through tensioning of the cable safeguard, is immovably secured on the underlying surface.

Owing to the invention-specific configuration, an anti-fall safeguard with supporting base is made available in which the supporting base, together with the attached anchor mast system, cannot shift on a "floor formwork" consisting of a prefabricated concrete slab.

For this, according to the invention, two or more cable safeguards are provided, which are able to be brought in connection with the reinforcing elements of the concrete slabs. Also, these cable safeguards are additionally tensible, so that the support base, through tensioning of the cable safeguard, is immovably secured on the underlying surface. In this connection, the cable safeguards can be an integral component of the supporting base. However, since this means a structural expenditure of a special type for the supporting base per se, such cable safeguards can also be configured by other means.

First, provision can be made that the cable safeguards be equipped with cable winches for tensioning, which are in direct or indirect connection with the supporting base via upright columns protruding upwards. By this configuration, in particular it is extremely easy to place tension on the cable safeguard, also with the tensioning direction able to be adjusted in an extremely simple way due to simple suspension and possible automatic alignment of the cable winch.

In addition, provision can be made that the cable safeguards with the cable winches and the upright columns are part of a separate plate, on which the supporting base of the anti-fall safeguard can be set up in fixed fashion.

Especially owing to this configuration, the cable safeguard is usable in variable fashion for the entire anchor mast system and the entire anti-fall safeguard. If the underlying surface permits that the anti-fall safeguard with its supporting base is able to be set up on its own without danger of a "slippage," as is the case, for example, on simple shuttering boards, then a cable safeguard is not necessary. Correspondingly, the anti-fall safeguard in such an instance can be employed without additional precautions.

However, if an underlying surface is provided, like the concrete slabs described in the outset, with their iron reinforcing components projecting upwards, which adhere only extremely lightly to the supporting base, then between the supporting base and these reinforcing components of the concrete slabs, an additional plate can be provided, which is provided with the cable safeguards and the cable winches and with the pertinent upright columns. Thus, due to the additional or separate plate, each anti-fall safeguard can as required be set up in a manner that does not allow shifting.

In addition, provision can be made that the plate consist of multiple annular ring elements, and that the ring elements be round or polygonal, and that the ring elements be connected with each other in fixed fashion via radially running connection braces. These ring elements can also consist, in the circumferential direction, of separate steel components or steel plates, which together form these annular ring segments. Providing these ring segments can especially reduce weight, with the plate at the same time having large-area carrying capacity. In the process, correspondingly as per, the ring segments are at a radial distance from each other, and with their surface sections directed downward, form the footprint for the downward-directed supporting base for the anti-fall safeguard placed on the upper side.

Aided by the figures, the invention is explained in greater detail in what follows.

DETAILED DESCRIPTION OF THE INVENTION

Figure 1:
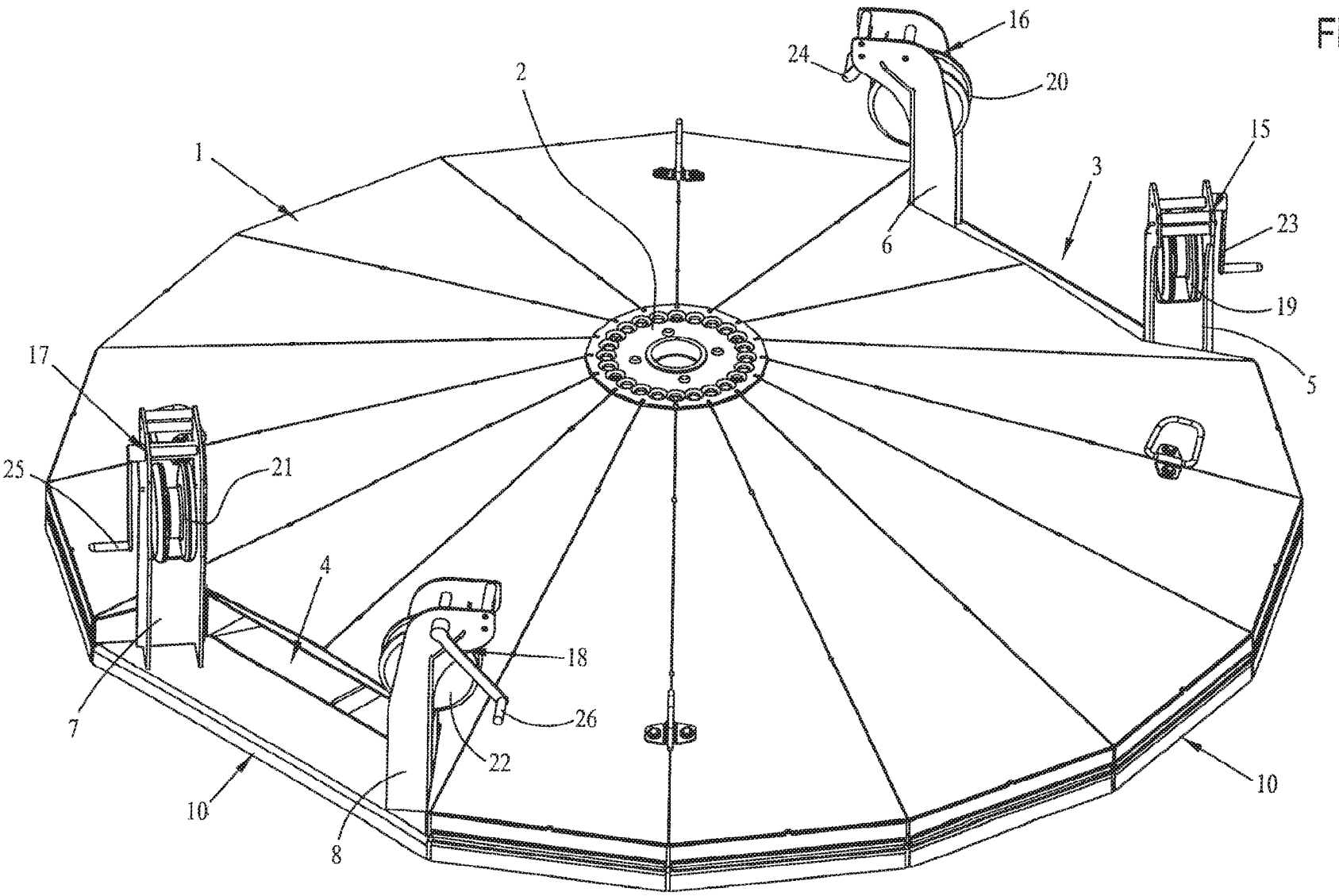
FIG. 1 a perspective view of a support base of an anti-fall safeguarding system, which has a base plate and cable safeguards as an integrated component.

FIG. 1 is a perspective view of a support base 1, as this is used with the anti-fall safeguard as per DE 20 2016 007 169.7 U1. As can be seen from FIG. 1, this support base 1 has a central mounting plate 2, which serves for fixed and pivoting admittance of an anchor mast system, as this is described in the above-named German utility model patent text.

Here, to the full extent, reference will be made to the anti-fall safeguard as per the above-named utility model.

Further seen from FIG. 1 is that support base 1 has opposite-placed recesses 3 and 4 relative to mounting plate 2, in the edge areas of which vertically directed upright columns 5, 6 and 7, 8 are arranged. Additionally seen from FIG. 1 is that support base 1 is set up on a kind of base plate 10, and is connected with same in fixed fashion. Support base 1 and base plate 10 have identically configured, polygonal outer contours, so that support base 1 is set up to fit to base plate 10.

With the embodiment version depicted, upright columns 5, 6 and 7, 8 can be connected in fixed fashion with base plate 10 in the proper depicted position in the edge area of the two recesses 3 and 4, and not arranged in forcibly fixed fashion on support base 1. However, here both versions are conceivable.

If upright columns 5, 6 and 7, 8 are directly connected with support base 1, then support base 1 is able to be used together with upright columns 5, 6 and 7, 8 without additional base plate 10.

Additionally evident from FIG. 1 is that upright columns 5, 6, 7, and 8 are each provided on their upper end area with a kind of cable winch 15, 16, 17 and 18. These cable winches 15 to 18 serve to admit corresponding securing cables, which are not depicted separately in FIG. 1.

As is depicted in FIG. 1 in regard to these cable winches 15, 16, 17 and 18, they have corresponding cable drums 19, 20, 21 and 22, which are able to be driven manually via corresponding manual cranks 23, 24, 25 and 26. These manual cranks 23, 24, 25, 26 are lockable, so that cables wound on cable drums 19, 20, 21 and 22 (not shown in the figure) can be detensioned, so that support base 1 together with base plate 10 can be secured from slipping vis-à-vis an underlying surface.

Figure 2:
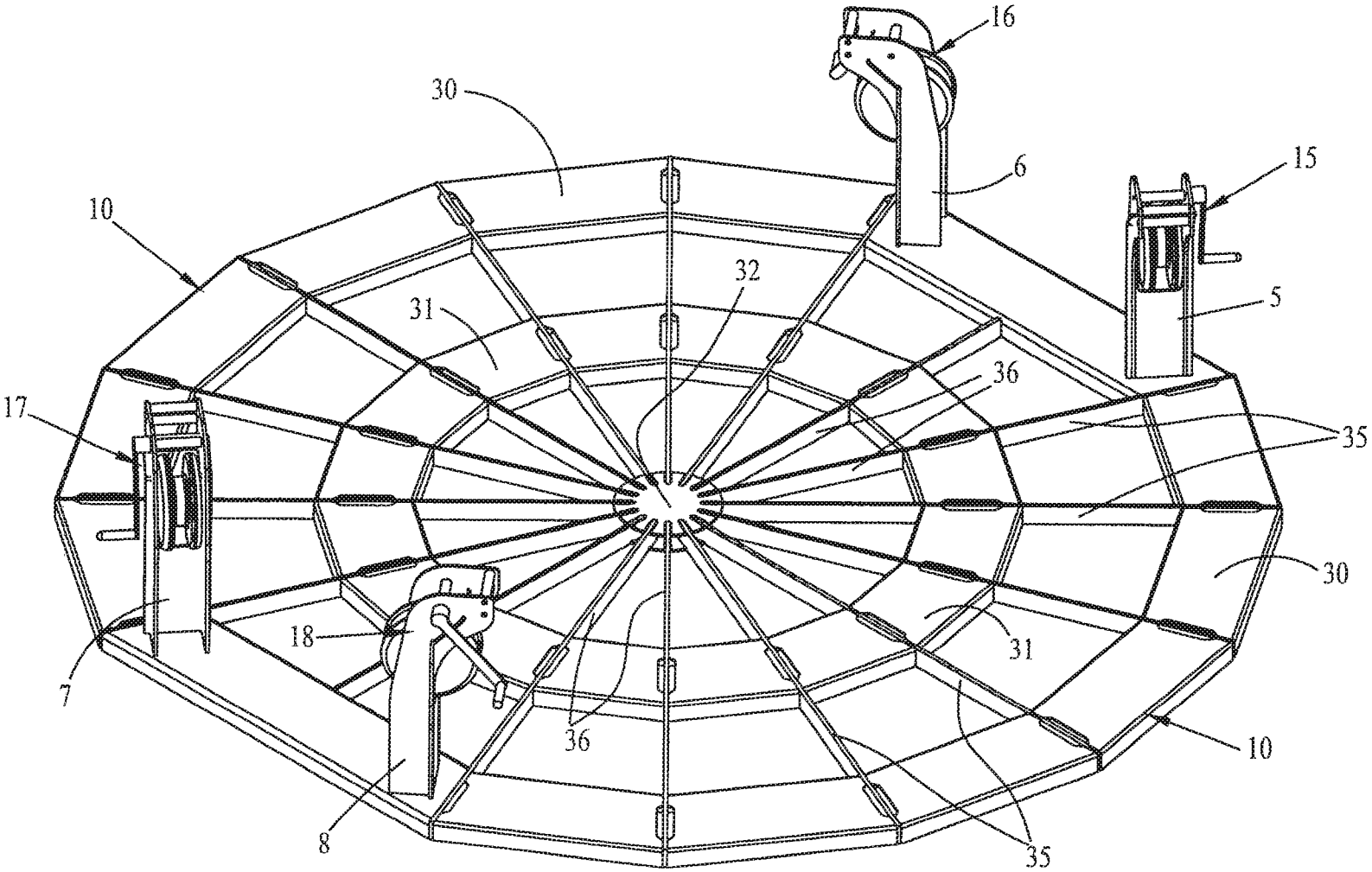
FIG. 2 a base plate on which the support base of FIG. 1 is able to be placed, as a separate component with upright columns directed vertically, which are provided on their upper end areas with pertinent cable winches for exerting tension on the cable safeguards.

For this, FIG. 2 shows a perspective view of a possible embodiment of a separate base plate 10, which is provided with the four upright columns 5, 6, 7 and 8 and their cable winches 15, 16, 17 and 18. Perceptible in FIG. 2 is that this base plate 10 consists of two concentric annular ring elements 30, 31, and a central circular disk 32. Dividing base plate 10 into two ring segments 30 and 31, and central circular disk 32, saves weight in particular, with the width of the ring segments being configured so that enough of a footprint is available for bracing of the FIG. 1 support base 1 to be set up.

To mutually stabilize ring segments 30 and 31, and central circular disk 32, these are connected with each other via multiple radial connection braces 35 and 36. The entire structure of the base plate can be configured as a welded structure. Especially a greater stability of all of base plate 10 is achieved.

Figure 3:
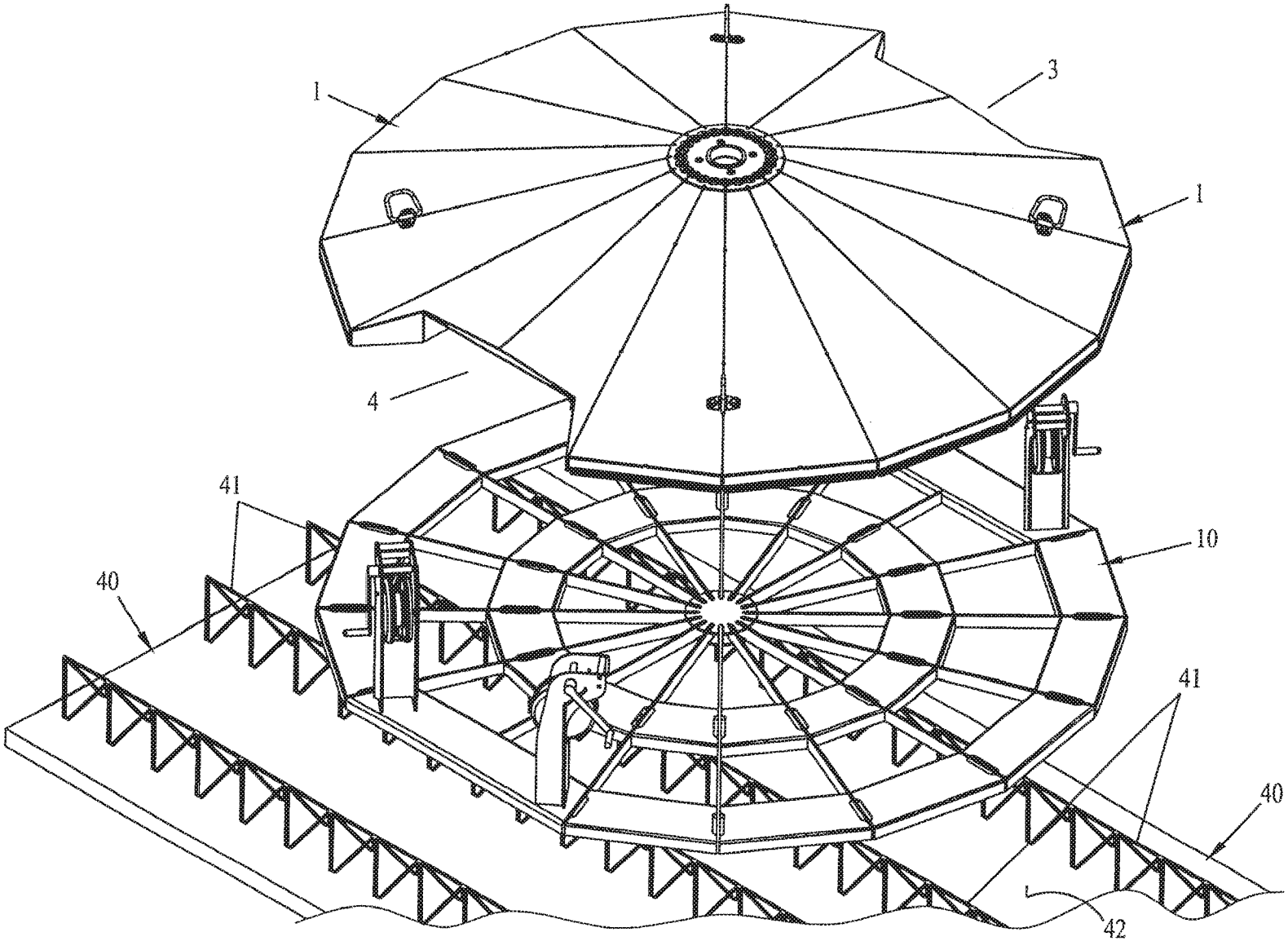
FIG. 3 a perspective exploded view of a support base, a base plate and a concrete slab arranged beneath this plate, with iron reinforcements projecting upward.

The individual ring segments 30, 31 in turn can themselves be formed from segments arranged in differing circumferential sections, which are not designated in greater detail in the figure. As mentioned at the outset, base plate 10 has a function on its upper side of admitting support base 1, and via the cable safeguards of its upright pillars 5, 6, 7 and 8 and of their corresponding cable winches 15, 16, 17 and 18 for immovable fixing of support base 1 on a concrete slab 40, as can be perceived as an example from FIG. 3.

It is perceptible that concrete slab 40, whose thickness is about 6-8 cm, is equipped with iron reinforcement elements 41, which project vertically upward toward the upper side 42 to base plate 10. At the same time, these iron reinforcement elements 41 form the footprint elements for base plate 10 and thus indirectly also for support base 1, which, as is depicted in FIG. 1, is able to be placed in fixed fashion on base plate 10 and is attachable to same.

To attain a fixed hold of base plate 10 together with support base 1 on iron reinforcement elements 41 projecting upwards, cable winches 15, 16, 17 and 18 are provided with their corresponding manual cranks 19, 20, 21 and 22.

Figure 4:
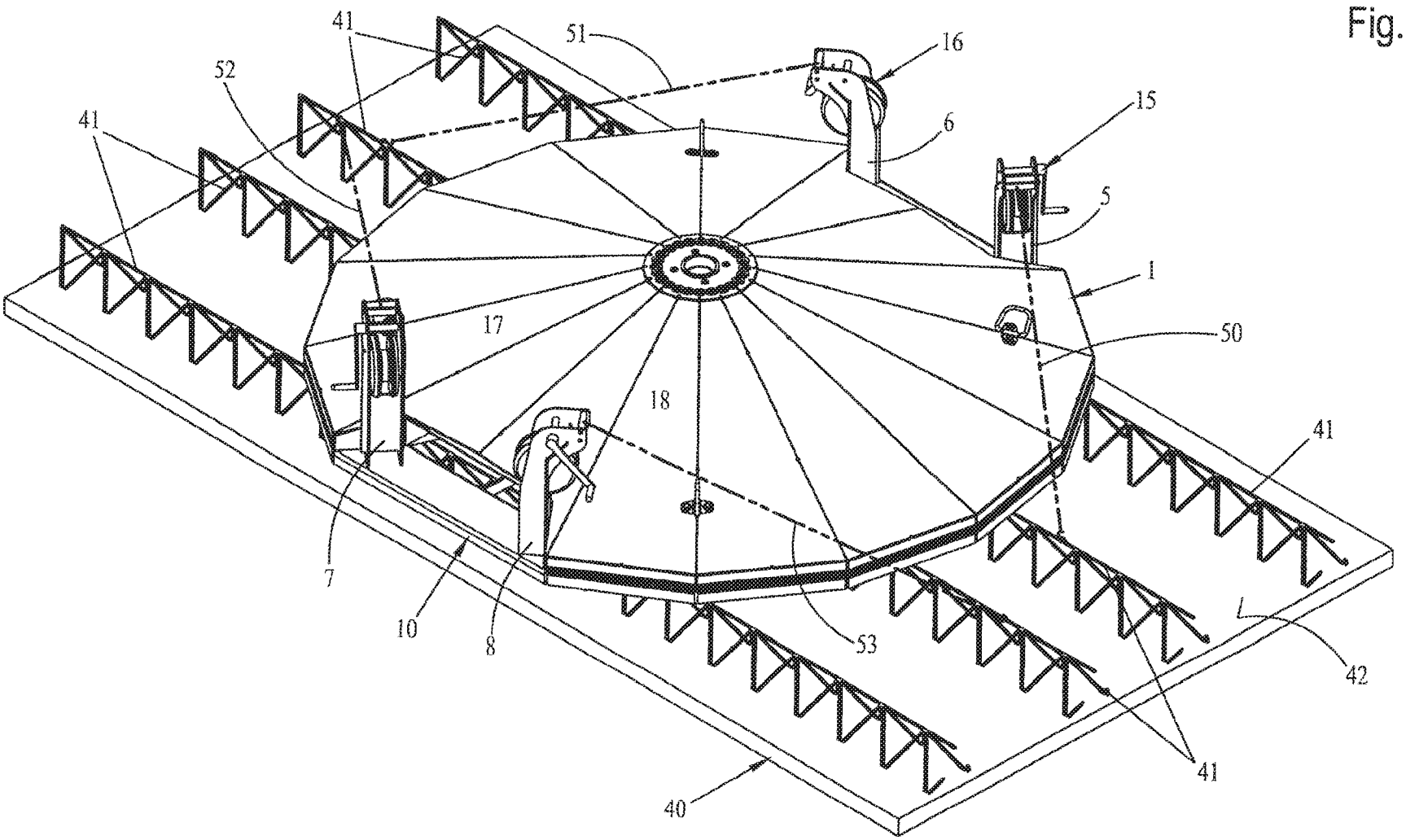
FIG. 4 the anti-fall safeguard with its support base and with its base plate serving as a footprint as well as the reinforcement plate from FIG. 4 in the set-up condition on the concrete slab.

For this, FIG. 4 is a perspective depiction of base plate 10 set onto iron reinforcement elements 41 of concrete slab 40, which in turn is mounted in fixed fashion to support base 1. It is seen that cable winches 15, 16, 17 and 18 are aligned at differing directions to each other, so that tensioning cables wound correspondingly onto cable drums 19, 20, 21 and 22 are able to be placed under tension against individual iron reinforcement components 41 projecting upwards.

Thus, by tensioning the cables in accordance with the cable safeguards 50, 51, 52 and 53 shown as examples in FIG. 4, what is attained is an immovable support of base plate 10 on iron reinforcement components 41 of concrete slab 40, and thus also an immovable support of support base 1 placed in fixed fashion on base plate 10.

Since in normal operation, support base 1 is equipped with an anchor mast system, certainly an anti-fall safeguard is ensured for persons, since especially the anchor mast system together with support base 1 is immovably secured on concrete slab 40 and its iron reinforcement elements 41.

What is claimed is:

1. An anti-fall safeguard for persons, the anti-fall safeguard comprising:

an underlying surface formed of a concrete slab (40) equipped with upwardly-projecting iron reinforcement elements (41);

a separate support base (1) for setting-up the anti-fall safeguard on said underlying surface;

an anchor mast system connected to said support base (1), said anchor mast system having a free, upper end for attachment of an item of personal protective equipment (PPE);

upwardly-projecting upright columns (5, 6, 7, 8);

at least two tensible cable safeguards (50, 51, 52, 53) configured to be brought into connection with said iron reinforcement elements (41) of said concrete slabs (40); and cable winches (15, 16, 17, 18) directly or indirectly connected to said support base (1) by said upwardly-projecting upright columns (5, 6, 7, 8) for tensioning said cable safeguards (50, 51, 52, 53) and securing said support base (1) by immovably tensioning said cable safeguards (50, 51, 52, 53) on said underlying surface.

2. The anti-fall safeguard according to claim 1, which further comprises a separate base plate (10) configured for setting-up and fixing said support base (1) on said base plate (10), said cable safeguards (50, 51, 52, 53) with said cable winches (15, 16, 17, 18) and said upright columns (5, 6, 7, 8) being part of said separate base plate (10).

3. The anti-fall safeguard according to claim 2, wherein said base plate (10) is formed of a plurality of polygonal or circular annular ring segments (30, 31), and radially running connecting braces (35, 36) fixedly connect said ring segments (30, 31) to each other.

4. The anti-fall safeguard according to claim 3, wherein said ring segments (30, 31) are disposed at a radial distance from each other, said ring segments (30, 31) have downwardly-directed surface sections forming a footprint for said support base (1), and said ring segments (30, 31) have upper sides on which said support base (1) is placed.

* * * * *